United States Patent [19]

Lante-Montefeltro Della Rovere

[11] 4,133,532

[45] Jan. 9, 1979

[54] SIMULATED TARGET PIGEON

[76] Inventor: Ludovico Lante-Montefeltro Della Rovere, Avenida Paez, Quinta Ismenia, El Paraiso, Caracas, Venezuela

[21] Appl. No.: 762,019

[22] Filed: Jan. 24, 1977

Related U.S. Application Data

[63] Continuation-in-part of Ser. No. 604,069, Aug. 12, 1975, abandoned, and Ser. No. 679,135, Jun. 3, 1976, Pat. No. 4,077,384.

[51] Int. Cl.[2] ..... F41J 9/16

[52] U.S. Cl. ..... 273/105.4

[58] Field of Search ..... 273/105.4; 46/82, 83, 46/84; 24/208 A, 73 P, 73 SM, 73 PF

[56] References Cited

U.S. PATENT DOCUMENTS

| | | | |
|---|---|---|---|
| 2,788,047 | 4/1957 | Rapata | 24/73 P UX |
| 3,176,988 | 4/1965 | De Ferdinando | 273/105.4 |
| 3,181,411 | 5/1965 | Mejlso | 24/73 P X |

*Primary Examiner*—William H. Grieb
*Attorney, Agent, or Firm*—Karl F. Ross

[57] ABSTRACT

A two-piece target pigeon composed of (a) a ring with propeller wings extending radially and which are tilted in propeller fashion so that when spun about the centerline axis of the ring by a launching apparatus, the ring will displace itself axially through the air; and (b) a detachable target piece which is carried by the propellered ring in flight. Structure on the target pieces mutually intercooperate to hold the ring and target piece together in flight and to release the target when hit in flight by pellets. The structure includes legs with footed distal ends which disengage from the ring upon impact, so that the target will fall to earth simulating a "dead bird" while the propellered hub will continue in flight.

9 Claims, 5 Drawing Figures

SIMULATED TARGET PIGEON

CROSS REFERENCE TO RELATED APPLICATIONS

This is a continuation-in-part of patent application Ser. No. 604,069 filed Aug. 12, 1975, now abandoned and my copending application Ser. No. 679,135, filed June 3, 1976 now U.S. Pat. No. 4,077,384, issued Mar. 7, 1978.

FIELD OF THE INVENTION

This invention relates to aerial targets and, more particularly, to a two-piece aerial target to simulate a pigeon in flight and which includes a frangible body portion which upon impact with pellets from a gun separates from a carrier and falls to the earth simulating a "dead bird."

RELEVANT PRIOR ART

This invention is, in general, an improvement of that disclosed in U.S. Pat. No. 3,176,988, the improvement residing primarily in improved structure for a smooth release of the device from a launching apparatus for flight in a path which is randomized in the sense that the launching apparatus does not launch any successively launched target piece for flight along a similar trajectory, and which target pigeon is separable readily upon impact by the shots of a marksman into two pieces, one which falls to the earth simulating a "dead bird" and the other of which continues in flight.

BACKGROUND OF THE INVENTION

This invention, generally, relates to an improved modern substitute of a clay pigeon in lieu of a live pigeon for competitive shooting purposes. Competitive live pigeon shooting has been for decades the toughest and most demanding of all targets. The unpredictable pattern of flight and speed of a live pigeon, as it springs up from the box, not only taxes the skill of the most experienced shooters, and they know that there will not be any two flights, on any given day, which will follow a relatively similar path at the same speed. Clay target shooting, on the contrary, is quite mechanical as the speed, trajectory and elevation of flight do not vary. Consequently, almost every target can be anticipated and high scores are often easily obtained. Some expert shooters, indeed, can hit hundreds of targets without a miss. Live pigeon shooting is very costly since is requires considerable breeding facilities and highly specialized personnel which are hard to find and train. Additionally, live pigeon shooting gives rise to complaints and protests from persons who are opposed to shooting live pigeons.

THE PRESENT INVENTION

The instant invention is of an improved aerial target which for most practical purposes replaces the live pigeon, giving a very good simulation of a pigeon flight on the shooting range. The target embodies a new concept in structure which results in a smooth launch of a propellered carrier ring and a target piece which is connected to the ring and which is adapted by the structure to be described to travel with the ring in flight until hit by pellets at which time the target separates from the carrier ring and falls to the earth simulating a dead bird. The invention offers unique advantages including that it has remarkably similar characteristics in flight of a live pigeon at a much more reasonable cost and which is less objectionable. It can be safely stored at most temperatures. Additionally, it may be utilized year round and does not require special skill in handling or use. The acceleration and trajectories of the aerial target of the instant invention provide a new challenge to a shooter, an important factor in developing his skills and developing him into a better performer at tournaments and in the field. The instant target provides superior performance for sportsmen throughout the world. The instant invention further provides a target which breaks easily when hit by only a few pellets.

Generally speaking, the target is composed of a propeller with blades which extend radially from a central ring and a disc attached within the ring of the propeller and which, upon impact by pellets, is dislodged from the propeller ring falling to the ground. When the target is hit, the disc falls and is called a "dead bird." In use, conventional scoring systems are utilized.

In trap or target-pigeon shooting a target pigeon is thrown up in the air to simulate a bird being driven out of the brush; and the shooter, usually armed with a shotgun, fires at this target to sharpen his abilities for actual wing shooting. In order to maximize the effectiveness of such a practice, it is necessary that the trap or target pigeon be launched into the air in a manner closely resembling a bird in the initial stage of flight. Since, however, there are many different behavior patterns in game birds, it is necessary that some of the traps be shot straight up at a high speed, some fired out low and almost parallel to the ground, others be given a spin so as to change course, and various other random patterns must be duplicated.

The most widely used trap launcher simply has a springloaded arm on whose end the frangible target pigeon is secured. The arm is displaced back against the force of a spring and locked in place by a pawl which, when released, allows the arm to snap up and launch the pigeon into the air. Such a device is normally operated by a person other than the shooter from a pit at the end of the shooting range, or can be operated remotely by the shooter himself through a trip cable. In order to vary the path or trajectory of the target it is necessary to reset the spring and physically turn the entire device around. Thus, reproducing random flight patterns is relatively difficult.

It has also been suggested to provide a pigeon which functions aerodynamically so that it can be launched and caused to follow its own trajectory. Nevertheless, the provision of the necessary launch arrangement has proven extremely complex and troubleprone. The use of an electric motor to launch the pigeon has been recommended, but the only way varying speeds and trajectories have been obtainable has been to use a direct-current motor in conjunction with complicated control circuitry. Such an arrangement is very troublesome and misfunctions often. Furthermore, the provision of a random firing angle, or range angle to be distinguished from the elevation angle which is the angle relative to the horizontal with which the pigeon is fired, has not been satisfactorily resolved.

OBJECTS OF THE INVENTION

It is therefore an object of the present invention to provide an improved target for use in a system for target-pigeon or trap shooting as is described more fully in my copending patent application Ser. No. 679,135 referred to above.

A main object of this invention is the provision of an improved simulated pigeon for such a system.

Yet another object is to provide an improved target for use with apparatus having a head to mate with the target for throwing it into the air with structure which permits a smooth release from the launch apparatus and travel in flight as a unit of two pieces which separate when hit by pellets of a marksman.

A further object of this invention is to provide structure for releasably connecting a target piece for flight in connected relation with a propellered ring and which will release the target piece readily when hit by the shot of a marksman.

These objects are attained according to the present invention in a practice shooting system which includes a launch apparatus, which does not comprise this invention. The invention relates, more specifically, to a target pigeon which is improved over that of U.S. Letters Pat. 3,176,988, referred to above. The target pigeon of the instant invention is composed of a propellered ring and interconnected target piece and the means for connecting the two pieces together. The device is for use with a launching apparatus which may include a base, a support pivotal on the base about an upright axis, a launch head on the support rotatable thereon about an axis inclined upwardly to the horizontal and formed with a tip centered on the inclined axis and engageable in the ring of the target pigeon. Drive means include a motor connected to the support and to the launch head for oscillating the support about the upright axis for rotating the head simultaneously about the inclined axis to spin a pigeon on the head about the inclined axis. Means is provided on the launch head for securing the target pigeon on the head with the tip in the bore and for pushing the pigeon off the head along the inclined axis to launch it into the air. The structure of the ring which engages the launch is improved as is more fully explained hereinafter for a smooth release of the two piece target pigeon.

The rotation axis for the launch head of a typical machine extends at an angle of between 20° and 40°, and preferably 30° to the upright oscillating axis for the support. As described in my copending application, the motor has a shaft extending parallel to the head rotation axis and at right angles to a swivel axis intersecting the upright pivot axis for the support.

The tip of the launch head fits into the hole in the target pigeon and has an oblique head and is formed at one side with a hook so that as the pigeon is pushed off it is deflected laterally. Since the entire support for the launch head is oscillating back and forth about the above-mentioned upright axis and since the pigeon is pushed off over this hook the line of flight will be almost completely random. Thus, the conditions of the flight of the released target closely approximate that of a bird and this is accomplished without the necessity of the target shooter having to reset the apparatus for varying types of shots.

In accordance with further features of this invention the target pigeon is made at least in part of frangible material. This pigeon may be formed as a hub or carrier ring that is formed with a central through hole or bore which is parallel to the axis and with diametrically opposed radially outwardly located recesses to receive off-centered drive pins carried on the launch head. The drive pins on the launch head, therefore, transmit torque to the pigeon to spin the same. It is preferred that two drive pins be utilized; however, a single drive pin may satisfactorily be utilized.

With the system according to the present invention the target, once spun at a high speed, takes off vertically by itself so that it can be given a very long flight path, closely resembling that of a flushed game bird. Successive flight patterns are randomized, however, by the reasons referred to above. Furthermore, the release from the launch head is smooth by reason of the structure of the ring which includes the outer edge or mouth entrance of the holes which are provided in the carrier ring web, as will be described, which mates and cooperates with the launch head for a smooth release. Furthermore, the target shooter is not able to know in advance the particular course to be followed by the next target pigeon, as the range and elevation, as well as the shape of the trajectory will change from shot to shot at random. In this manner the conditions of wing shooting are closely emulated.

Additionally, the means for effecting the separation of the propellered carrier ring and the target piece are improved so that the two remain as a unit in flight but separate readily upon impact by pellets of a marksman.

DESCRIPTION OF PREFERRED EMBODIMENT

Figure 1:
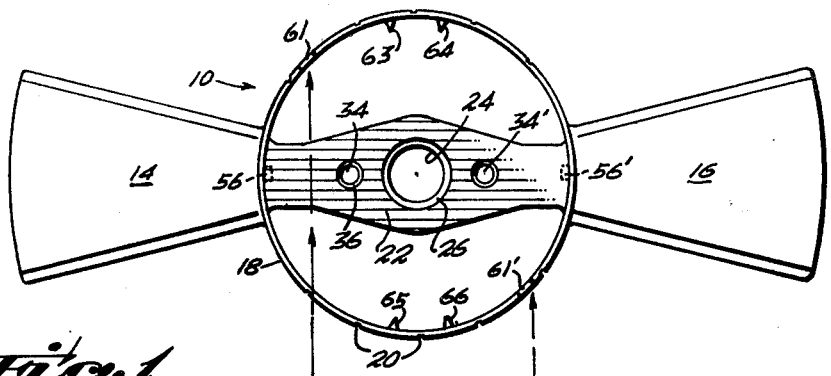
FIG. 1 is an exploded plan view of the propeller ring with radially extending wings and, below that, the mating frangible substantially disc-shaped target which mates with the ring as indicated by the arrowed lines.
Figure 2:
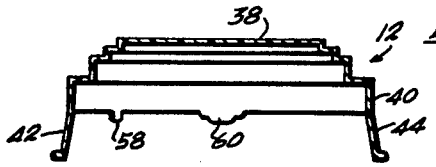
FIG. 2 is a side elevation view taken on the plane indicated by the line 2—2 of FIG. 1 and looking in the direction of the arrows.
Figure 3:
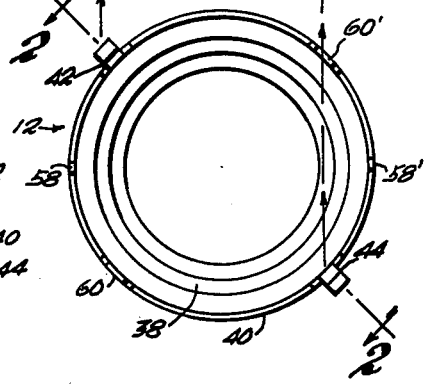
FIG. 3 is an enlarged view of the right-hand side of FIG. 2.
Figure 3:
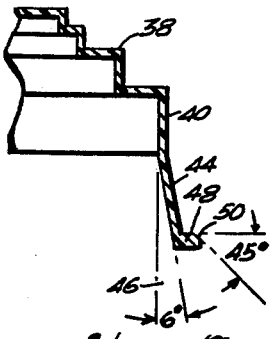
Figure 4:
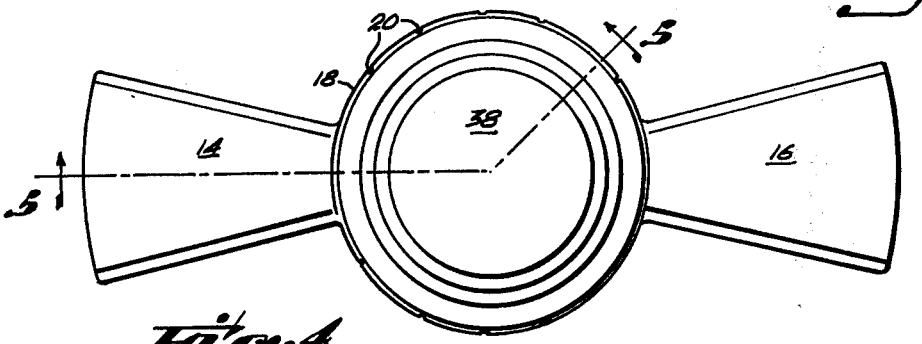
FIG. 4 is a view, similar to FIG. 1; however, showing the disc-shaped member mated with the propeller ring.
Figure 5:
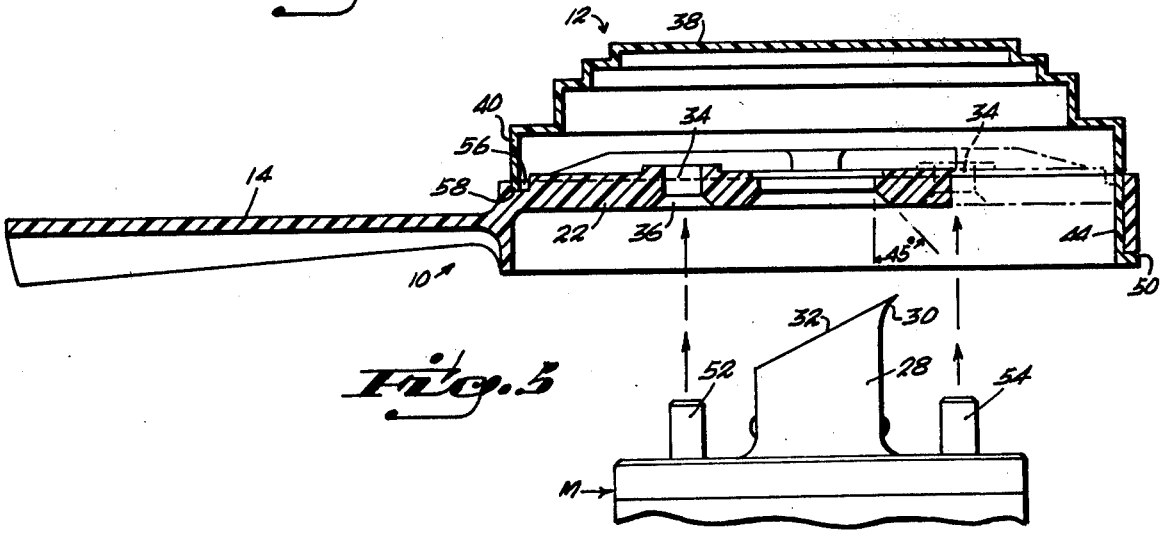
FIG. 5 is a view in cross section taken on the planes indicated by the line 5—5 of FIG. 4 and looking in the direction of the arrows and illustrating a portion of the launching apparatus.

Referring to the drawings wherein like reference characters designate like or corresponding parts throughout the several views and referring particularly to FIG. 1, there is shown the propellered ring 10 and the mating disc or target 12. The propellered ring includes propeller blades 14 and 16 extending in diametrically opposite relation with their proximal ends connected to the generally cylindrical ring 18 in a fashion to be explained. On the exterior surface of the ring 18 axially extending spaced flutes, such as that designated by the numeral 20 are provided. The ring is provided with a web 22 extending diametrically thereacross which has a central through axial opening, as seen in FIG. 5, the view of the web in cross section illustrates that the opening or hole 24 includes a bottom facing mouth having side walls inclined outwardly at an angle of about 45° with respect to the axial dimension, as is indicated by the numeral 26 in FIG. 1. This is to mate with the central spindle 28 of a machine M with an angled end face 32 that terminates in an outwardly curved tip 30. Additionally, radially outwardly of the hole 24 in diametrically opposed relation there are two additional through holes provided, and designated by the numerals 34 and 34' in FIG. 1 and each of which has an angled entrance mouth as indicated by the numeral 36 with the included angle being about 45° with respect to the axial centerline, as indicated by the numeral 36 in FIGS. 1 and 5. These holes are for mating engagement with the drive pins 52 and 54 of a machine for use with the device. Referring now to the disc 12 and, particularly, to FIGS. 2 and 3, it is seen that the disc or hub includes an annular stepped top 38 with a generally axially extending skirt 40 from which there extend two diametrically opposed snap legs 42 and 44. As seen in FIG. 3, the legs diverge with respect to the axial centerline at an angle of about 6°, as indicated by the numeral 46. The snap legs terminate at an outturned portion or foot 48 having a radially extending rim with a top edge and a bottom edge and an outer side edge, with the rim being beveled at the outer edge at an angle of about 45° between the top edge and the side edge as illustrated. To accommodate mating of the disc and the propellered ring, means are provided for orienting and connecting the two pieces together. These means include positioning holes 56 and 56' in the top surface of the web which mate with axially extending prongs 58 and 58' which are in diametrical opposition to one another for receipt in the two holes 56 and 56'. Additionally, projections which extend axially and which are designated by the numerals 60 and 60' fit within and abut the inside surface of the ring.

In assembly, it will be seen that the legs 42, 44, which may be somewhat yieldable and, hence, resilient, are of a length equal to the length of the ring. The openings or notches 61 and 61', into which the feet of the legs nestingly fit, are sized such that the end of the legs does not increase the overall length of the ring, or, indeed, its thickness. Further, the axially extending projections 60 and 60' extend into abutting relation with the inside of the ring and exert a frictional force further holding and gripping the target or disc to the carrier ring in flight and guarding against relative wobbly motion of the two pieces. However, the two pieces are readily separable upon impact as by the pellets from the gun of a marksman which will cause the target to snappingly break from engagement with the carrier ring and fall to the earth, resembling a "dead bird," while the propellered carrier ring will continue in flight. It will be seen that while normally the legs 42 and 44 diverge with respect to one another at an angle of about 12°, so that, in effect, each diverges outwardly with respect to its zone of juncture with the skirt terminal end at an angle of about 6°, this is not necessary but, merely, constitutes a preferred and illustrated embodiment. This embodiment defines a somewhat resilient or yieldable leg to further exert and outwardly biased mating surface with the inside of the surface of the carrier ring. It is important, however, to this invention that the upper outer face of the feet on the legs be beveled, preferably at about 45°, as shown, see the edge 50 in FIG. 3, for example, and at the lower right of FIG. 5, so that a relatively small inboard gripping force is exerted upon the skirt for a ready release upon impact. Representative prior art is that of U.S. Letters Patent No. 3,176,988 however, in the field, it has been discovered that the quick release upon impact simulating a true flight of a bird which has been killed cannot be counted upon; but that it can be counted on when the target device embodies the structure described above. Further, with respect to the shape of the drive pin holes and the central hole in the web and, particularly, the provision of the smooth entrance mouth, the head of the machine M, see FIG. 5, cooperates with the companionate surfaces of the machine and the mouths of the holes for a smooth release when being launched to cause a truly randomized unobstructed release and simulated flight.

It will be seen that the means to connect the two pieces of the device together cause the target or disc to fit tightly in interlocked relation with the carrier ring while in flight so that relative movement of the two does not cause an undesirable relative wobbling motion between the two pieces through its trajectory on a random flight pattern; and, further, that the improved mutually intercooperating means for connecting the target and ring include the structural arrangement of the legs, particularly at the projections 60, 60' and the shape of the outer edge 50 of the feet of the legs, which, together, interengage with the ring, the latter engaging the ring in the notches 61, 61' which are provided depthwise on the periphery of the ring skirt and, together, prevent release in flight but readily release upon command as by the impact of pellets from the gun of a marksman.

With reference to FIG. 1, it is seen that positioning surfaces 63, 64 and 65, 66 are provided against which the lower terminal end of the skirt dwells. These are provided for ease of assembly of the two pieces. In assembly, the drive prongs 58 and 58' are inserted into the positioning holes 56 and 56' with the projection 60 engaging the inside surface of the ring and with the feet 48 on the end of the legs 42 and 44 being engaged in the notches 61 and 61'. In the event that the target piece is not exactly coaxial with the ring, the skirt on one side or the other of the web may tend to tilt down into the ring. These positioning surfaces 63, 64 and 65, 66 guard against this and together with the upper end of the skirt provide the upper surface upon which the target piece dwells for ease of assembly.

What is claimed is:

1. A target pigeon, comprising a generally cylindrical ring part centered on an axis;

two angularly spaced blades extending radially outwardly from said ring part and each located in a respective plane lying at an acute angle to said axis and inclined propeller-fashion to the plane of the other blade;

a witness part lying generally in a plane perpendicular to said axis and having an outer periphery generally axially aligned with said ring part; and two angularly spaced axially extending and radially deflectable legs formed on one of said parts and extending therefrom axially past the other of said parts, each of said legs having a radially extending foot formed with a surface facing toward the other of said parts and having one surface portion engaging said other part and another surface portion which is inclined radially outwardly of and axially away from said other part and includes an acute angle with said axis, each of said beveled surface portions being engageable with said other part on axial stressing of said parts away from each other to cam the respective leg inwardly and thereby detach said parts from each other when said pigeon is impacted while in flight.

2. The pigeon defined in claim 1 wherein said beveled surface portion of each leg includes an angle of generally 45° with said axis.

3. The pigeon defined in claim 1 wherein said witness part is a disk having a cylindrical rim constituting said periphery.

4. The pigeon defined in claim 3, and further comprising axially interengaging formations between said periphery and said ring part, whereby said parts are connected for joint rotation about said axis.

5. The pigeon defined in claim 1 wherein said parts are each made integrally.

6. The pigeon defined in claim 1 wherein said legs extend from said periphery past said ring part.

7. The pigeon defined in claim 6, wherein said feet extend radially outwardly from the respective legs.

8. A target pigeon, comprising a generally cylindrical hub ring centered on an axis;

at least two angularly equispaced blades extending radially outwardly from said hub ring and each lying in a respective plane lying at an acute angle to said axis and inclined propeller-fashion to the plane of the other blade;

a cap at one axial side of said hub ring and lying generally in a plane perpendicular to said axis, said cap having a generally cylindrical periphery axially aligned with and axially bearing on said hub ring; and at least two angularly equispaced connecting legs each extending axially from said cap past said hub ring to the other axial side thereof, each of said legs being radially deflectable and having one axial end secured to said cap and another end formed with a radially projecting foot extending radially of said hub ring and having a bearing surface which is engaged against said other axial side and a radially outer surface portion of which is located in a plane extending at an angle of 45° to said axis and is bevelled in direction radially outwardly and away from said other axial side so that there is a reduced surface-to-surface contact between said bearing surface and said other axial side which is sufficient to prevent separation of said cap from said hub ring when said pigeon is merely in flight but is minimal enough to result in their immediate separation when the pigeon is impacted while in flight.

9. The pigeon defined in claim 8 wherein said periphery and said hub ring are formed with axially extending interengaging formations inhibiting relative rotation of said cap of and said hub ring about said axis.

* * * * *